US005475886A

United States Patent [19]

Mintz

[11] Patent Number: 5,475,886

[45] Date of Patent: Dec. 19, 1995

[54] COMBINATION PILLOW AND CHAIR CUSHION WITH TIE STRING ACCOMODATING POCKET

[75] Inventor: Jacob Mintz, Fall River, Mass.

[73] Assignee: Klear-Vu Corporation, Fall River, Mass.

[21] Appl. No.: 305,593

[22] Filed: Sep. 14, 1994

[51] Int. Cl.[6] ..... A47G 9/00; A47C 27/00

[52] U.S. Cl. ..... 5/653; 5/636; 5/369; 297/228.12; 297/188.01

[58] Field of Search ..... 5/653, 654, 636, 5/639, 640, 645, 462, 485; 297/228.12, 188.01

[56] References Cited

U.S. PATENT DOCUMENTS

| | | | |
|---|---|---|---|
| 1,677,743 | 7/1928 | Berton | 5/653 |
| 1,776,983 | 9/1930 | Rotherham | 5/653 |
| 1,974,723 | 9/1934 | Richig | 5/653 |
| 2,413,828 | 1/1947 | Hirsh et al. | 5/639 |
| 4,116,310 | 9/1978 | Shields | 190/42 |
| 4,535,878 | 8/1985 | Grahl | 5/639 |
| 4,783,120 | 11/1988 | Keichlin | 15/639 |
| 4,863,003 | 9/1989 | Carter | 5/420 |
| 4,914,765 | 4/1990 | Smith | 5/639 |
| 4,945,589 | 8/1990 | Carey . | |
| 5,056,533 | 10/1991 | Solano | 5/81.1 |
| 5,111,544 | 5/1992 | Graebe | 5/485 |
| 5,138,728 | 8/1992 | Aston | 5/645 |

*Primary Examiner*—Alexander Grosz

*Attorney, Agent, or Firm*—Harold James; Robert L. Epstein; James & Franklin

[57] ABSTRACT

When in use on a chair, sets of strings which extend from the seam proximate an expandable pocket are tied around vertical elements of the chair back to secure the cushion. The strings are stored within the pocket when the product is used as a decorative pillow. The pocket material matches the material of the side wall and may be similarly pleated, so as to be visually unobtrusive. The product saves space and money because it can be used as a decorative pillow or a seat cushion, as needed.

6 Claims, 2 Drawing Sheets

COMBINATION PILLOW AND CHAIR CUSHION WITH TIE STRING ACCOMODATING POCKET

The present invention relates to pillows and more particularly to a pillow which can be converted for use either as a decorative pillow, for example, to adorn a couch or bed, or as a cushion for a chair set.

In situations where a very small living space or carrying capacity is involved, it may be necessary to limit the number of pillows present as much as possible. This is because pillows tend to be bulky and thus take up considerable room and are difficult to carry and store. The present invention overcomes this problem by providing a single pillow which is easily convertable to function either as a decorative or "throw" pillow and as a chair seat cushion. My invention thus saves space. Moreover, it can be sold at a cost comparable to pillows capable of performing only one of the functions and thus saves money as well.

A chair seat cushion is provided with a means for securing it to a chair as it rests on the seat such that the cushion maintains the desired position. One simple and commonly used method to do this is to employ pairs of the strings which extend from the rear of the cushion, often from the seam. These strings are adapted to be tied around vertical elements of the chair back to anchor the cushion.

Decorative or throw pillows, on the other hand, do not require tie strings as they are not intended to be anchored. Having such strings would be considered unsightly and substantially detract from the decorative nature of such pillows. Accordingly, it has been heretofore necessary to have separate decorative pillows without tie strings and chair seat cushions, with tie strings, in order to achieve both functions acceptably.

I have provided for convertability by incorporating an elastic compartment or pocket along the rear of the product, proximate the area from which tie strings extend. The compartment encloses and retains the tie strings when they are not in use. The exterior of the compartment is similar in appearance to the remainder of the product exterior, so the presence of the compartment does not change the appearance of the product. With this simple structure, the invention is capable of dual function, either as a decorative pillow with the strings hidden or as a chair seat cushion with the strings exposed.

It is therefore, a prime object of the present invention to provide a combination pillow and chair cushion.

It is another object of the present invention to provide a combination pillow and and chair cushion which includes an elastic compartment or pocket proximate the area from which the tie strings extend.

It is another object of the present invention to provide a combination pillow and chair cushion which saves space and can be produced at a price comparable to conventional single function pillows or cushions.

In accordance with the present invention, a combination pillow and chair cushion is provided. It includes a body and means for anchoring the body to a chair. An expandible compartment is situated on the body, proximate the anchoring means. The anchoring means are adapted to be retained in the compartment, when not in use.

Preferably, the body includes a seam. The seam is located proximate the compartment. The anchoring means extends from the seam. The anchoring means includes a tie string, preferably spaced pairs of tie strings.

Preferably, the compartment includes an edge with an elastic strip. The surface of the compartment is preferably pleated so as to have an appearance similar to that of the pleaded side wall of the product.

The body may include top and bottom surfaces and a side wall with a rear section. The seam from which the anchoring means extends is preferably between the bottom surface and the rear section of the side wall.

To these and to such other objects which may hereinafter appear, the present invention relates to a combination pillow and chair cushion, as described in the following specification and recited in the annexed claims, taken together with the accompanying drawings, in which like numerals refer to like parts, and in which:

Figure 1:
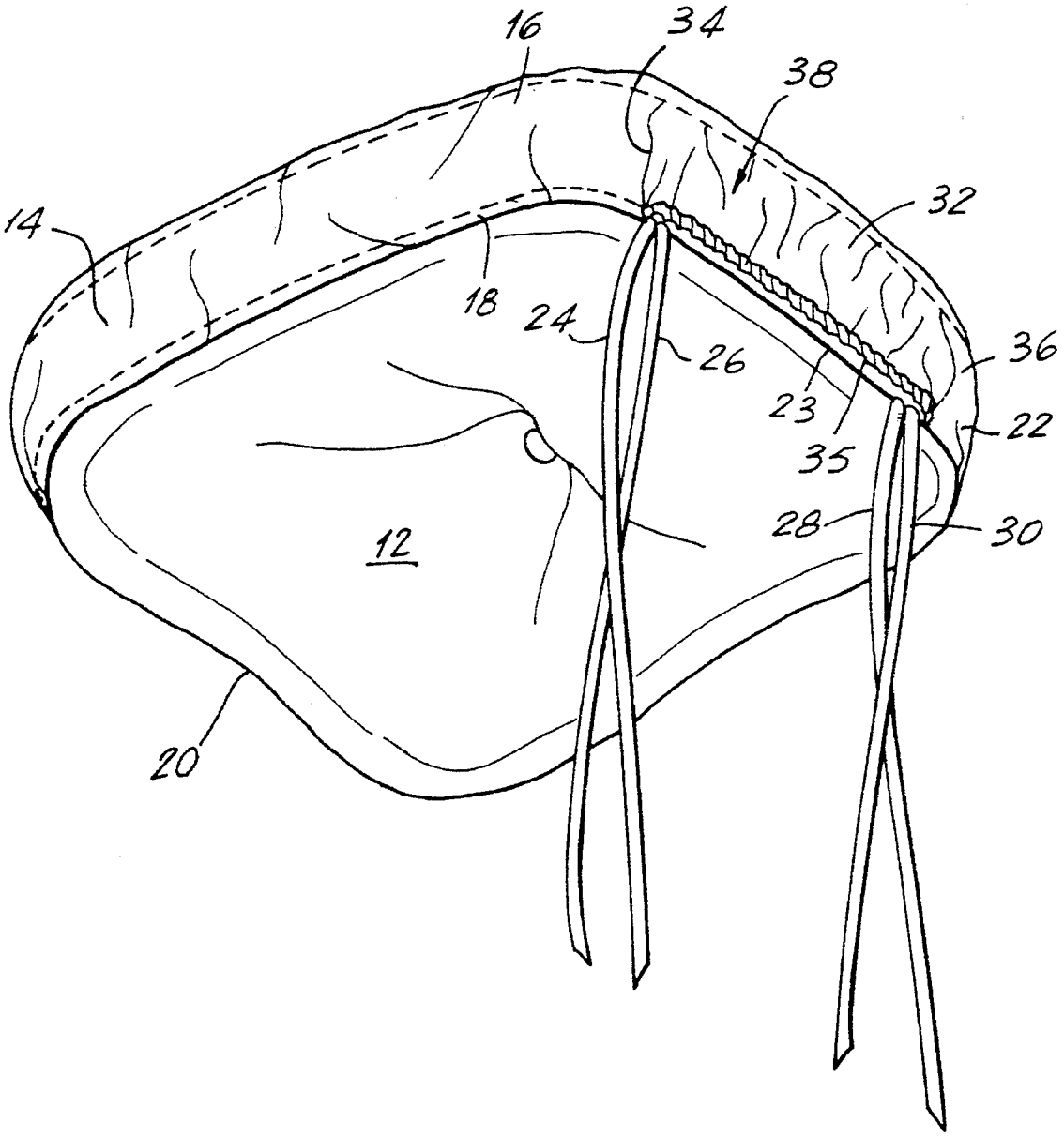
FIG. 1 is a perspective view of my invention, showing the tie strings extended.

As seen in the drawings, the present invention comprises a body made of a top surface 10, a bottom surface 12 and a side wall 14. The top edge of side wall 14 is attached to the edge of top surface 10 by a seam 16. The bottom edge of the side wall 14 is attached to the edge of bottom surface 12 along seam 18.

Wall 14 has a forward section 20 and a rear section 22. Extending from the portion 23 of seam 18 which extends across section 22 are spaced pairs of tie strings. Strings 24, 26 are situated proximate one end of seam portion 23. Strings 28, 30 are situated proximate the other end of seam portion 23.

Sewn along seam 16 and extending across wall section 22, is an extra sheet of material 32 which is preferably similar in appearance to the remainder of wall 14. Both the side wall 14 and sheet 32 are made of the same material and may be pleated. The sides of sheet 32 are sewn to wall 14 along seams 34, 36. The non attached edge 35 of sheet 32 is preferably elastisized by a strip of elastic 37 such that the compartment or pocket 38 formed by sheet 32 is expandable.

Figure 2:
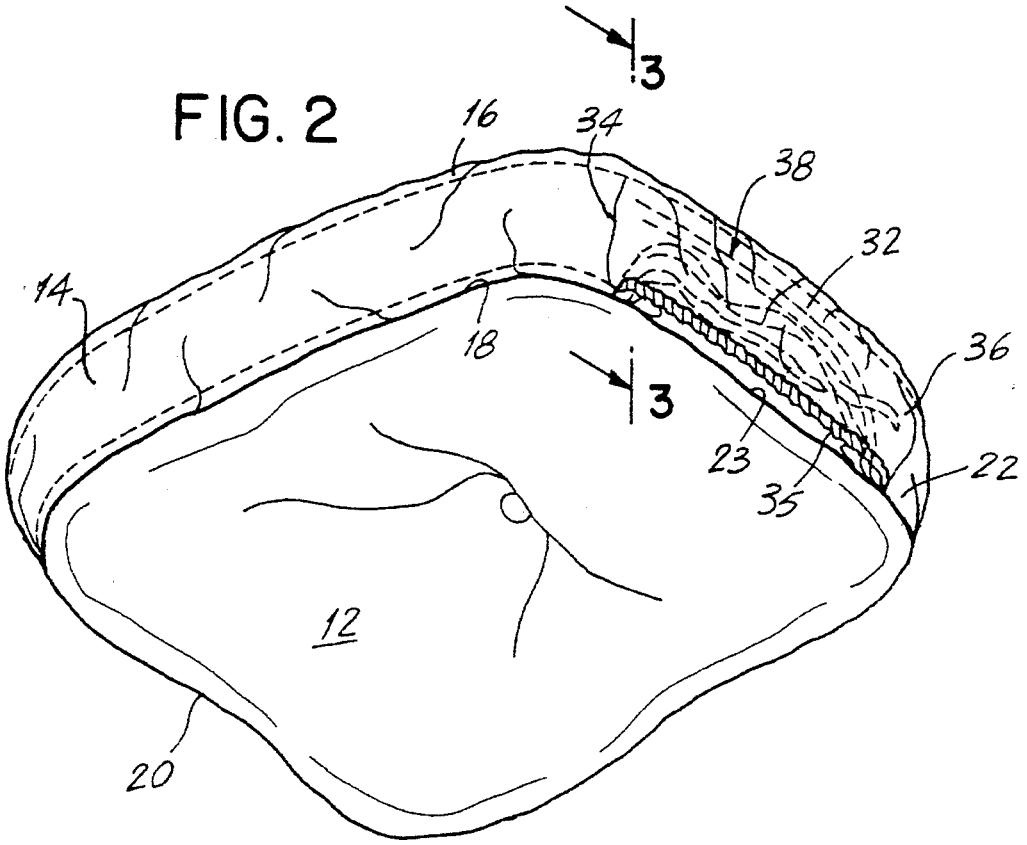
FIG. 2 is a view similar to FIG. 1, showing the strings retained on the pocket.
Figure 3:
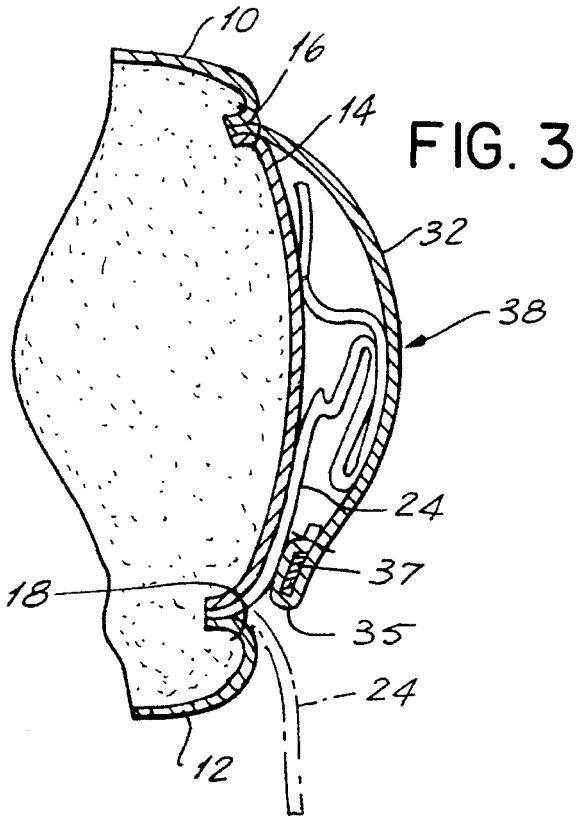
FIG. 3 is a cross-sectional view taken along line 3—3 of FIG. 2.

Strings 24, 26, 28 and 30 are normally retained within pocket 38 when not in use. When retained in this manner, the strings are completely hidden and pocket 38 appears to be the rear section of the side wall (FIG. 2 and FIG. 3). When used as a chair cushion, the tie strings are extended from pocket 38 (FIG. 1) and available to be tied to vertical elements of the chair, so as to anchor the cushion.

It should now be appreciated that the present invention relates to a combination pillow and chair cushion which is both space saving and inexpensive, costing only about as much as a conventional single function product. The expandable pocket makes the product convertable for use either as a decorative pillow or a chair seat cushion.

While only a single preferred embodiment has been disclosed for purposes of illustration, it is obvious that many variations and modifications could be made thereto. It is intended to cover all of these variations and modifications which fall within the scope of the invention, as defined by the following claims:

I claim:

1. A pillow adapted to be used as a chair cushion or a decorative pillow, comprising a top surface, a bottom surface and a side wall, defining a compartment with cushioning material therein, said side wall being joined by top and bottom seams to said top surface and said bottom surface, respectively, an expandable pocket, said pocket comprising a sheet of material having and edge, said pocket being joined along said edge to one of said top or bottom seams, first and second tie strings extending from the other of said seams, proximate said pocket, said tie strings adapted to be stored within the pocket when the pillow is used as a decorative pillow, and said strings adapted to be tied around vertical elements of a chair back, when the pillow is used as a chair cushion.

2. The pillow of claim 1 wherein said side wall has a rear section and wherein said pocket extends along said rear section.

3. The pillow of claim 1, wherein a portion of said pocket comprises elastic means.

4. The pillow of claim 1 wherein said top surface, said bottom surface, said side wall and said pocket comprise the same material.

5. The pillow of claim 1, wherein said pocket comprises pleated material.

6. The pillow of claim 5, wherein said top surface, said bottom surface and said side wall comprise pleated material.

* * * * *